United States Patent [19]

Avellanet

[11] Patent Number: 4,974,382

[45] Date of Patent: Dec. 4, 1990

[54] INFILTRATION AND ENERGY BARRIER

[75] Inventor: Frank J. Avellanet, Westport, Conn.

[73] Assignee: Constructonika, Inc., Miami, Fla.

[21] Appl. No.: 294,476

[22] Filed: Jan. 6, 1989

[51] Int. Cl.[5] ..... E04B 1/74; B32B 15/04

[52] U.S. Cl. ..... 52/408; 428/457

[58] Field of Search ..... 52/404–408; 428/457–461

[56] References Cited

U.S. PATENT DOCUMENTS

| | | | |
|---|---|---|---|
| 1,615,801 | 1/1927 | Elmendorf . | |
| 2,033,752 | 3/1936 | Billingham | 154/45.9 |
| 2,065,045 | 12/1936 | Broback et al. | 20/91 |
| 2,276,076 | 3/1942 | Finck | 52/408 |
| 2,779,066 | 1/1957 | Gaugler et al. | 52/406 |
| 2,863,179 | 12/1958 | Gaugler | 52/406 |
| 3,041,219 | 6/1962 | Steck | 154/45 |
| 3,111,419 | 11/1963 | Nahin | 428/461 |
| 3,276,944 | 10/1966 | Levy | 428/461 |
| 3,650,803 | 3/1972 | Lin | 428/458 |
| 3,707,433 | 12/1972 | Clough et al. | 428/461 |
| 3,785,913 | 1/1974 | Hallamore | 161/41 |
| 3,967,033 | 6/1976 | Carpenter | 428/307 |
| 4,037,006 | 7/1977 | Roberts et al. | 428/71 |
| 4,196,242 | 4/1980 | McLaren | 428/138 |
| 4,201,833 | 5/1980 | Kirsch et al. | 428/404 |
| 4,310,587 | 1/1982 | Beaupre | 52/408 |
| 4,405,682 | 9/1983 | Fujita et al. | 428/317.7 |
| 4,433,019 | 2/1984 | Chumbley | 428/110 |
| 4,514,454 | 4/1985 | Cooley | 428/195 |
| 4,564,544 | 1/1986 | Burkard et al. | 428/70 |
| 4,661,398 | 4/1987 | Ellis | 428/245 |
| 4,766,029 | 8/1988 | Brock et al. | 428/286 |

OTHER PUBLICATIONS

Levins and Karnitz, "Cooling Energy Measurements of Unoccupied Single-Family Houses with Attics Containing Radiant Barriers," Jul. 1986, pp. 1–14.

Remodeling, p. 128, Mar. 1988.

Remodeling, p. 143, Jul./Aug. 1988.

Parsec Radiant Barrier Brochure, "Radiant Barrier for Energy Conservation", Jan. 1986.

Parsec Retroflect Panels Brochure, Jan. 1986.

Eagle Shield Brochure 3, "Products Catalog," p. 2.

Duracote Product Descriptions, Aug. 1988.

Tyvek Housewrap Brochure.

Eagle Shield Brochure 1, "Introduction to Radiant Barrier," pp. 6–7.

*Primary Examiner*—James L. Ridgill, Jr.

[57] ABSTRACT

An infiltration and energy barrier comprising a flexible substrate sheet having at least one metalized layer thereon is applied to a structure in a substantially continuous manner and is disposed between the structural underlayment and the finish material to enhance the energy efficiency of the structure. In accordance with the desired application, the infiltration and energy barrier may be either impermeable or vapor permeable.

12 Claims, 3 Drawing Sheets

FIG. 3
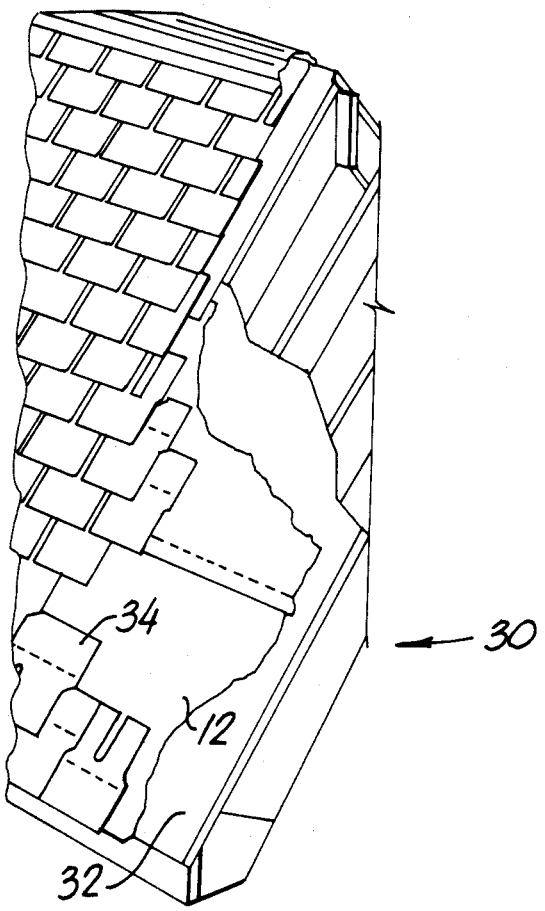
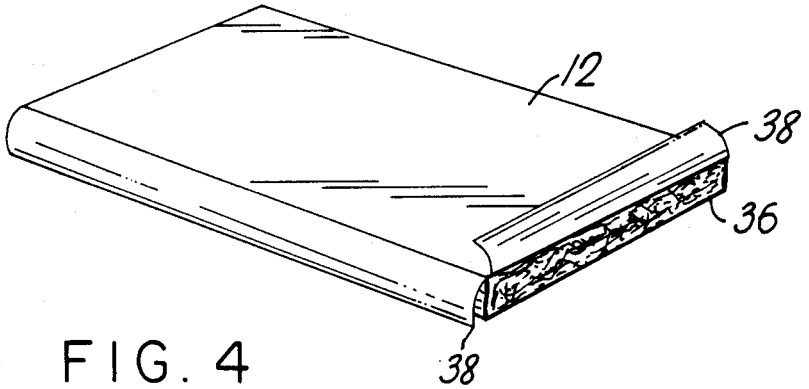
FIG. 4

INFILTRATION AND ENERGY BARRIER

BACKGROUND OF THE INVENTION

This invention relates to infiltration barriers used in building construction. More particularly, this invention relates to infiltration barriers used in building construction to improve energy efficiency.

In recent years, due to increased energy costs, efforts have been made to improve the energy efficiency of new and existing buildings. It is now common practice in building new structures, and in residing old structures, to cover the exterior wall sheathing with a "housewrap" infiltration barrier prior to installation of the siding. One such infiltration barrier is a high density polyethylene fiber sheeting sold by E. I. du Pont de Nemours & Company, Inc. under the trademark TYVEK. While infiltration barriers cut down on drafts and thereby convective heat loss, they provide little other contribution to the energy efficiency of the structure.

Another method of increasing the energy efficiency of buildings is to cover the exterior wall sheathing with foam insulating panels having a reflective surface thereon. One such foam insulating panel is sold by Celotex Corporation under the trademark CELOTEX. While these panels provide both conductive and radiant heat barriers, the panels are of rigid construction and typically 0.25 inches in thickness. As installation requires cutting and fitting of the panels, significant additional labor in construction of the building is required. Further, these panels attach between the sheathing and the siding and may thereby detract from the solid nailing surface provided by the sheathing for the siding. The foam insulating panels also do not provide an infiltration barrier as air may seep in around the joints between consecutive panels.

SUMMARY OF THE INVENTION

With the foregoing in mind, it is an object of the invention to provide an infiltration and energy barrier with a convective and radiant energy barriers incorporated therein.

It is a further object of the invention to provide an infiltration and energy barrier material having sufficient strength to withstand the handling encountered during the construction process.

The infiltration and energy barrier according to the invention comprises a flexible substrate sheet having at least one metalized layer thereon. The substrate sheet is applied to a structure in a substantially continuous manner and is disposed between the exterior wall sheathing and the siding. In accordance with the desired application, the infiltration and energy barrier may be either impermeable or vapor permeable.

The infiltration and energy barrier according to the instant invention provides both a convective and a radiant energy barrier that is directly incorporated into the structure of the building. The infiltration and energy barrier is provided in such a manner that it requires little or no additional labor to install and is positioned in the structure in such a manner as to be most effective.

BRIEF DESCRIPTION OF THE DRAWINGS

The accompanying drawings, referred to herein and constituting a part hereof, illustrate preferred embodiments of the invention and, together with the description, serve to explain the principles of the invention, wherein:

FIG. 3 is a partial cutaway perspective view of a roof section incorporating the infiltration and energy barrier;

FIG. 4 is a perspective view of an sheathing panel with the infiltration and energy barrier thereon;

DETAILED DESCRIPTION OF THE DRAWINGS

In accordance with the present invention, an infiltration and energy barrier including a flexible substrate sheet with at least one metalized layer thereon and applications thereof are provided. The infiltration and energy barrier of the present invention has both convective and radiant energy barrier characteristics and may be directly incorporated into the structure of new and existing buildings to improve the energy efficiency thereof.

The substrate sheet of the infiltration and energy barrier may be a flexible material such as a polyester sheet, which is preferred for use in the present invention for reasons of economy. Other suitable substrate sheets can be made of, for example, polyester, polycarbonate, polypropylene, polyethylene, polyamide, paper, aluminum foil, and cellophane. If a low melting plastic such as polyethylene is employed, an additive may be incorporated in the plastic to raise its melting point to a level satisfactory for any intended use. The thickness of the substrate sheet can be, for example, on the order of 1.0 mil.

A metal layer is provided on the substrate sheet by conventional metallizing techniques such as by vacuum metallizing. Alternate metallizing techniques include thermal or catalytic decomposition, electrolytic and electroforetic deposition, sputtering and ion deposition techniques. The metallizing may be carried out conventionally at high rates normally associated with the processing of plastic films. The metal layers are preferably very thin. For example, a thickness of less than 1.0 mil, is suitable for use herein. Although the metal layers can comprise aluminum, copper, chromium, nickel, gold, silver, and the like, for reasons of economy, a thin layer of aluminum applied by vacuum metallizing is preferred for use in the present invention.

For applications where a semi-permeable infiltration and energy barrier is desired to allow moisture vapor to pass and prevent in-wall condensation, a substrate such as high density polyethelene fiber sheeting may be used and a porous metalized layer may be applied thereto. In this manner, the infiltration and energy barrier will retain its radiant and convective energy barrier characteristics while allowing moisture vapor to escape the structure thereby preventing condensation problems.

Figure 1:
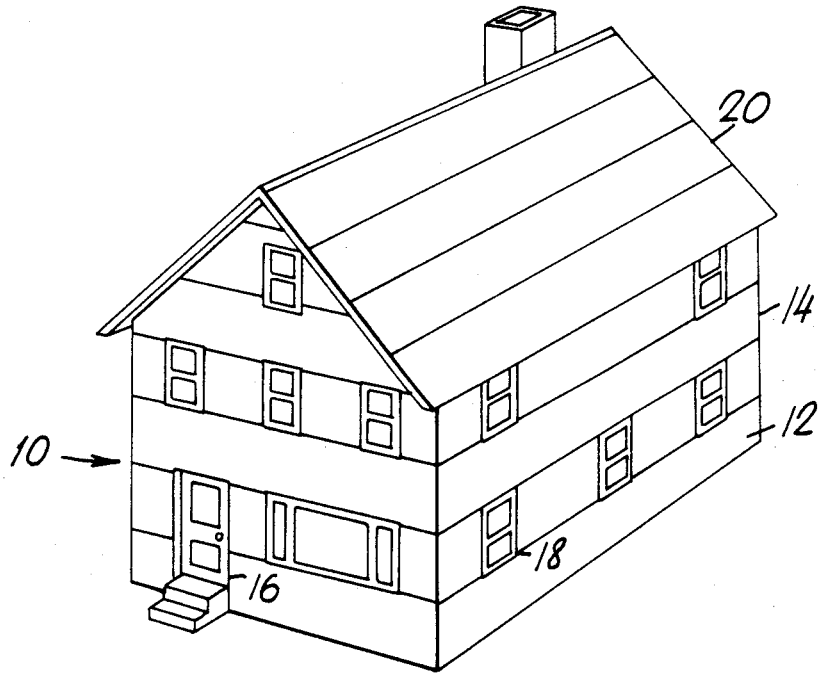
FIG. 1 is a perspective view of a structure wrapped with an infiltration and energy barrier according to the instant invention.

Referring to FIG. 1 of the drawings, application of the infiltration and energy barrier 12 to a structure 10 is illustrated. For economy, the infiltration and energy barrier is preferably provided in continuous rolls several feet in width and several hundred feet in length. The structure is then "wrapped" with the infiltration and energy barrier starting at the bottom of the structure. Typically, the infiltration and energy barrier is applied by two installers. The installers start at one corner of the structure and roll the infiltration and energy barrier in a single layer across an entire wall 14, wrapping around corners and over door 16 and window 18 openings. One installer rolls, and the other installer follows applying staples or roofing nails to fasten the infiltration and energy barrier to the structure. When the structure 10 is wrapped, the installers go back and X-out window 18 and door 16 openings with a knife, pulling the infiltration and energy barrier in over the frames.

Subsequent layers are applied by again wrapping the infiltration and energy barrier around the outside of the structure overlapping the previously applied layer. Each layer overlaps the previous layer by approximately 3 inches thereby providing substantially continuous coverage of the structure. Once the infiltration and energy barrier is installed, finish siding may be applied to the exterior of the structure.

The infiltration and energy barrier may also be applied to the roof 20 of the structure 10 in a similar manner to the walls 14. The infiltration and energy barrier is rolled out across the roof 14, starting at the bottom, and fastened in place. Subsequent layers are applied overlapping the lower layers by approximately 3 inches to provide substantially continuous coverage of the roof area. Once the infiltration and energy barrier is installed, finish roofing material may be applied to the roof of the structure.

As will be appreciated from FIG. 1, when applied to a structure in the foregoing manner, the infiltration and energy barrier serves to fully enclose the building in a radiant and convective heat barrier. Accordingly, heat within the structure will be retained in the winter and incident heat on the structure will be blocked in the summer. Thus, heating and cooling costs are significantly reduced. Further, as the infiltration and energy barrier is applied over the sheathing or other underlayment and under the finish siding or roofing, it is incorporated directly into the structure of the building.

Figure 2:
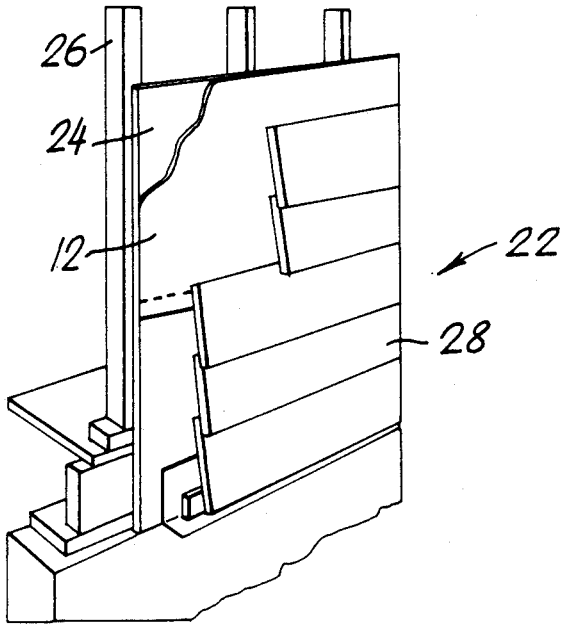
FIG. 2 is a partial cutaway perspective view of a wall section incorporating the infiltration and energy barrier.

Referring to FIG. 2, a cutaway view of a finished wall section 22 incorporating the infiltration and energy barrier 12 is illustrated. The infiltration and energy barrier 12 is attached by staples to sheathing 24 which in turn is attached to wall studs 26. Subsequent layers of infiltration and barrier 12 are overlapped to provide substantially continuous coverage of the wall section. The finish siding 28 may thereafter be applied directly over the infiltration and energy barrier 12 and, as it is only a few mils thick, the infiltration and energy barrier 12 will not interfere with secure attachment of the siding 28 to the sheathing 24. As will be appreciated by those skilled in the art, alternatively the infiltration and energy barrier 12 may be be attached directly to wall studs 26 or other underlayment and similar advantageous results will be achieved.

In applying the infiltration and energy barrier 12 to the wall section 22, it may also act as a vapor barrier preventing the movement of moisture vapor into and through the wall section. However, as previously discussed, the user may prefer to apply a semi-permeable infiltration and energy barrier to the walls of the structure thereby allowing the passage of moisture vapor to prevent in-wall condensation.

Referring to FIG. 3, a cutaway view of a finished roof section 30 incorporating the infiltration and energy barrier 12 is illustrated. The infiltration and energy barrier 12 is stapled to roof sheathing 32 in overlapping rows beginning from the bottom and working upward. The roofing shingles 34 are thereafter applied over the infiltration and energy barrier 12 by nailing them to the roof sheathing 32. The infiltration and energy barrier 12 is thereby completely enclosed between the roof sheathing 32 and shingles 34 and forms an integral part of the building structure protecting the barrier within.

In applications such as roofing of structures, water leakage is a significant consideration. Accordingly, the infiltration and energy barrier used in this particular application should be non-permeable to moisture vapor to insure no dampness during wet periods.

As an alternative method of installing the infiltration and energy barrier, sheets may be pre-installed to wall or roof sheathing panels as illustrated in FIG. 4. Sheathing such as gypsum sheathing panel 36, for example, may have a sheet of infiltration and energy barrier 12 fixedly attached thereto by adhesive. Preferably, the sheet of infiltration and barrier 12 includes an overhanging portion 38 that extends beyond the sides of the sheathing panel 36 on at least one side. Upon installation, the overhanging portion 38 may be attached to an adjoining sheathing panel to prevent air seepage therebetween and to form a substantially continuous infiltration and energy barrier about the structure.

As will be appreciated from the foregoing, the application of an infiltration and energy barrier according to any instant invention provides many distinct and important advantages. The infiltration and energy barrier as applied herein completely covers the surface area, just below the finish material, of the structure and is therefore most effectively situated. The infiltration and energy barrier forms part of a composite construction material comprising an underlayment, an infiltration and energy barrier, and finish material. The infiltration and energy barrier becomes an integral part of the structure upon installation so that no portion of the interior of the house need be dedicated to its use and the barrier is fully protected from any possible damage. The infiltration and energy barrier is simple to install and serves as a direct replacement for conventional infiltration barriers and felt paper. The minimal thickness of the infiltration and energy barrier does not detract from secure fastening of finish siding or roofing material to sheathing or other underlayment. The infiltration and energy barrier is also adaptable for use with virtually any kind of siding and roofing material.

An important application of the above-described infiltration and energy barrier is for use with radiant heating systems or other energy radiating fixtures. Radiant heat panels are rarely installed in exterior walls because the heat loss is too great. Extra-heavy insulation would reduce such loss, but would also greatly increase installation costs. However, by incorporating the infiltration and energy barrier material into the structure between the radiant heat panel and the outside environment, the heat from the radiant heat panel may be reflected back into the structure rather than lost to the environment.

Similarly, when radiant heat panels are installed in interior walls, 25 percent of panel output is lost to the adjoining room where the panel is not insulated. Additional insulation may be installed in the wall, but installation cost and wall thickness increases. Incorporating the infiltration and energy barrier material into the wall behind the radiant heat panel serves to direct the panel output to the desired room.

Figure 5:
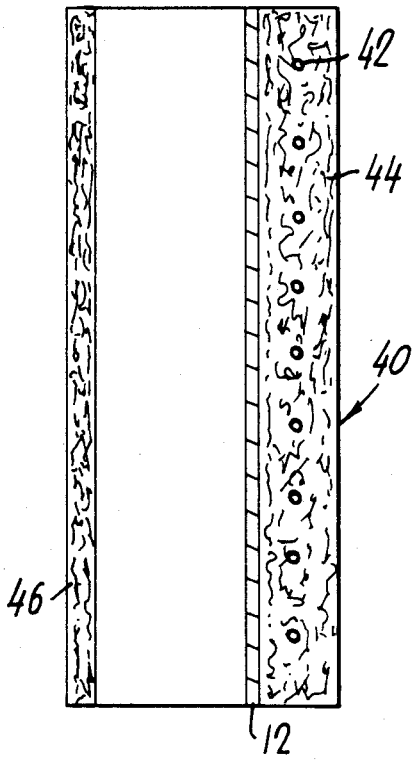
FIG. 5 is a sectional view of an interior wall section incorporating the infiltration and energy barrier.

Referring to FIG. 5, a sectional view of a finished interior wall section with a radiant heat panel 40 and incorporating the infiltration and energy barrier 12 is illustrated. The radiant heat panel 40 includes heat tubes 42 imbedded in plaster 44. Installed directly behind the radiant heat panel is infiltration and energy barrier 12. It will be appreciated by those skilled in the art that similar advantages and benefits will be obtained if the infiltration and energy barrier material 12 is installed behind the finish wall surface of the adjoining interior wall 46. It will further be appreciated that incorporating the infiltration and energy barrier into immediately adjacent structural surfaces such as walls, floors, and ceilings around energy radiating fixtures such as saunas and whirlpool baths will greatly enhance the energy efficiency of these fixtures.

Figure 6:
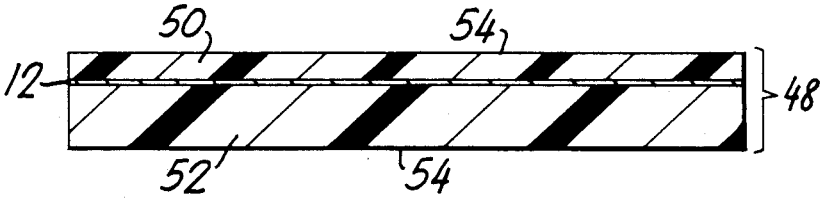
FIG. 6 is a sectional view of a composite door incorporating the infiltration and energy barrier.

Referring to FIG. 6, a sectional view of a composite door 48 incorporating the infiltration and radiant barrier 12 is illustrated. The composite door 48 includes a first panel 50, infiltration and energy barrier material 12, and a second panel 52. The panels 50, 52 may be made of wood, plastic, metal, or other material in accordance with the desired application and have surfaces suitable for forming the exterior surfaces of the completed door. The panels 50, 52 are fixedly attached together by adhesive or fasteners and the infiltration and energy barrier 12 is incorporated therebetween. The outside surfaces 54 of the door panels may be finished as desired and veneer strips applied to the edges of the composite door 48 to conceal the barrier within. It will be appreciated by those skilled in the art that by incorporating the infiltration and energy barrier in the door as set forth herein, insulation may be added to a structure where little or no conventional insulation is capable of being installed, thereby resulting in less heat transfer. It will be further appreciated that for this particular application a metalized layer is sufficient by itself and a flexible substrate need not be used.

While the invention has been described in its preferred embodiments, it is to be understood that the words which have been used are words of description, rather than limitation, and changes may be made within the purview of the appended claims without departing from the true scope and spirit of the invention in its broader aspects.

What is claimed:

1. An infiltration and energy barrier, comprising a semi-permeable flexible substrate sheet having at least one metalized layer thereon.

2. An infiltration and energy barrier according to claim 1, wherein said flexible substrate sheet comprises polyester.

3. An infiltration and energy barrier according to claim 1, wherein said flexible substrate sheet comprises high-density polyethelene fibers.

4. An infiltration and energy barrier according to claim 1, wherein said metalized layer comprises aluminum.

5. A composite construction material, comprising:

(a) a structural underlayment;

(b) a semi-permeable flexible substrate sheet having at least one metalized layer thereon; and (c) finish material attached to said underlayment with said flexible subtrate sheet disposed therebetween.

6. A composite construction material according to claim 5, wherein said flexible substrate sheet comprises polyester.

7. A composite construction material according to claim 5, wherein said substrate sheet comprises high-density polyethelene fibers.

8. A composite construction material according to claim 5, wherein said metalized layer comprises aluminum.

9. A composite construction material according to claim 5, wherein said structural underlayment comprises sheathing.

10. A composite construction material according to claim 9, wherein said flexible substrate sheet is not coextensive with said layer of sheathing.

11. A composite construction material according to claim 9, wherein said sheathing is plywood.

12. A composite construction material according to claim 9, wherein said sheathing is gypsum board.

* * * * *